US007257882B2

(12) United States Patent
Welzel et al.

(10) Patent No.: US 7,257,882 B2
(45) Date of Patent: Aug. 21, 2007

(54) MULTILAYER COIL ASSEMBLY AND METHOD OF PRODUCTION

(75) Inventors: Alexandra Welzel, Hahnheim (DE); Marcus Breuer, Dalheim (DE); Guenther Crolly, Goellheim (DE); Michael Haag, Rodenbach (DE); Manfred Jung, Limburg (DE); Rolf Schaefer, Mainz (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/308,405

(22) Filed: Mar. 22, 2006

(65) Prior Publication Data

US 2006/0261921 A1 Nov. 23, 2006

(30) Foreign Application Priority Data

May 19, 2005 (EP) ..... 05104237

(51) Int. Cl.
*H01F 7/06* (2006.01)

(52) U.S. Cl. ..... 29/606; 29/592.1; 29/602.1; 29/609; 216/22; 216/39; 216/41; 216/48; 336/65; 336/83; 336/200; 336/206; 336/223; 336/232; 336/233

(58) Field of Classification Search ..... 29/592.1, 29/602.1, 606, 609; 216/22, 39, 41, 48; 336/65, 336/83, 200, 206–208, 223, 232, 233
See application file for complete search history.

(56) References Cited

U.S. PATENT DOCUMENTS

| | | | | |
|---|---|---|---|---|
| 5,095,357 | A * | 3/1992 | Andoh et al. | 257/379 |
| 5,319,158 | A | 6/1994 | Lee et al. | |
| 6,037,649 | A * | 3/2000 | Liou | 257/531 |
| 6,444,920 | B1 * | 9/2002 | Klee et al. | 174/260 |
| 2003/0157368 | A1 | 8/2003 | Nguyen Van Dau et al. | |
| 2004/0130323 | A1 | 7/2004 | Oohashi et al. | |

FOREIGN PATENT DOCUMENTS

JP 05121239 A * 5/1993

OTHER PUBLICATIONS

"Electromechanical analysis of a prototype 20 Tesla, single turn toroidal field coil for IGNITEX"; Hsieh, K.T.; Driga, M.D.; Weldon, W.F.; Werst, M.D.; Fusion Engineering, 1989. Proceedings., IEEE Thirteenth Symposium on Oct. 2-6, 1989; pp. 1138-1141.*

* cited by examiner

*Primary Examiner*—Paul D Kim
(74) *Attorney, Agent, or Firm*—Yuanmin Cai

(57) ABSTRACT

Embodiments of the present invention provide a thin-film coil assembly. The coil assembly includes a substrate, at least two layers of conductive material on top of the substrate, and one layer of insulating material between the two layers of conductive material, wherein the two layers of conductive material are in contact with two interconnects, respectively, which extends substantially vertical to the substrate.

6 Claims, 7 Drawing Sheets

MULTILAYER COIL ASSEMBLY AND METHOD OF PRODUCTION

CROSS-REFERENCE TO RELATED APPLICATIONS

The present application claims priority of a European Patent Application No. 05104237.2 filed May 19, 2005, the content of which is incorporated herein by reference in its entirety.

FIELD OF THE INVENTION

The present application relates to a multilayer coil assembly, in particular to a multilayer thin-film coil assembly and its production.

BACKGROUND OF THE INVENTION

Thin-film coils used in creating magnetic fields in semiconductor devices are generally used in connection with magnetic field sensors.

For example, U.S. Pat. No. 5,319,158 (Lee et al.) relates to a semi-conductor device with an integrated coil. The coil may provide a strong magnetic field with a relatively good homogeneity. On the other hand, low power consumption is required, especially when the coil is integrated in a semiconductor assembly or a mobile device.

There are single winding thin-film coils that may provide electromagnetic field of a relatively good homogeneity. But in order to achieve a strong intensity of the field, it may be necessary to drive these single winding thin-film coils with a high current.

There are also known thin-film coils with multiple windings in a single layer. For example, U.S. patent application Ser. No. 2004/0130323 describes an electromagnetic field sensor having such a single layer coil with multiple windings.

These thin-film coils may be produced by any known thin-film technologies such as, for example, by forming a spiral shaped conductive layer on a substrate. The electromagnetic field generated by such thin-film coils may increase with the number of windings so that power consumption may decrease. On the other hand, since the windings have to be spaced apart from each other in a horizontal direction, the gaps between neighboring windings may cause the homogeneity of the generated electromagnetic field to decrease. Therefore a single layered thin-film coil with a large number of windings may not be able to produce a strong electromagnetic field with a relatively good homogeneity.

SUMMARY OF THE INVENTION

It is an objective of the present invention to provide a thin-film coil assembly that may generate an electromagnetic field with good homogeneity and low power consumption. It is also an objective of the present invention to provide a method of producing the thin-film coil assembly suitable for mass production.

According to one embodiment of the invention, there is provided a thin-film coil assembly having a substrate, at least two layers of conductive material on top of the substrate, and one layer of insulating material between the two layers of conductive material and wherein the two layers of conductive material are in contact with at least two interconnects, respectively, and the two interconnects extending substantially vertically to the substrate.

One embodiment of the invention enables stacking multiple windings on each other to produce a coil assembly that may generate a strong electromagnetic field with low power consumption. The stacked coils may be connected to the surface of a package containing multiple layers of conductive and non-conductive materials. It should be understood that other parts of the coil assembly may exist on the surface and the coil assembly may be mounted in an electronic device.

In accordance with one embodiment of the invention, the layers of conductive material may be at least partially stacked on each other. A multilayer coil with windings stacked on each other may provide an electromagnetic field with a good homogeneity.

Preferably, the layers of conductive material may be connected in series through one or more interconnects and one or more top windings. The multiple windings may be formed in one single process step.

The layers of conductive material and insulating material may each have a thickness less than 200 nm, preferably less than 100 nm. This thickness may be realized in a deposition process. The thin layers may allow the formation of small gaps between the windings.

Furthermore, embodiment of the invention may provide a method of forming a three-dimensional coil assembly by providing a substrate, depositing alternating layers of conductive material and insulating material on the substrate, and forming a three-dimensional structure of the coil assembly. The conductive layers may be contacted via one or more passageways extending vertical to the substrate. The three-dimensional coil structure may be formed by an etching process. Windings may be formed by a deposition of conductive material through a mask. The substrate may also form a first layer of the insulating material and/or may include other parts of the coil assembly. For example, the substrate may include a magneto restrictive sensor.

Preferably, the layers of conductive material and insulating material are deposited alternatively in one process step. It is possible to form all windings in one process step. Also several layers of conductive material can be made in contact in one process step.

Etching methods may be used to form passageways through the layers of conductive material and insulating material. The passageways may be used for contacting the windings. For example, passageways through the layers of insulating material may be formed by a dry etching method, e.g., by a reactive ion mill method. Passageways through the conductive layers may be formed by a selective wet etch process, using the layers of insulating material as etch stop layers.

According to one embodiment of the method, sidewalls of the passageways through the layers of conductive material may be at least partly insulated by an insulating material re-deposited from the layers of insulating material during a dry etch process. Therefore, passageways used for contacting lower layers of conductive material may be formed with sidewalls insulated against upper layers of conductive material.

Embodiment of the invention may also provide a method of bonding a multilayer board by providing a substrate with alternatively stacked layers of conductive material and layers of insulating material. For contacting the layers of conductive material, passageways may be formed by alternating dry etching of the layers of insulating material and wet etching of the layers of conductive material. Sidewalls of the passageways may be at least partly insulated by an insulating material from the layers of insulating material during the dry etching process. The layers of conductive material are contacted through one or more interconnects formed through the passageways.

Embodiment of the method may also be used to form a multilayer coil assembly with passageways according to this invention. Sidewalls of the passageways may be insulated through re-deposition of the layers of insulating material during dry etching processes, which is normally undesired. Accordingly, further process steps for insulation may not be required.

BRIEF DESCRIPTION OF THE DRAWINGS

Various embodiments of the present invention will be described below in detail by way of examples only and by making reference to the drawings, of which.

DETAILED DESCRIPTION OF THE INVENTION

Figure 1:
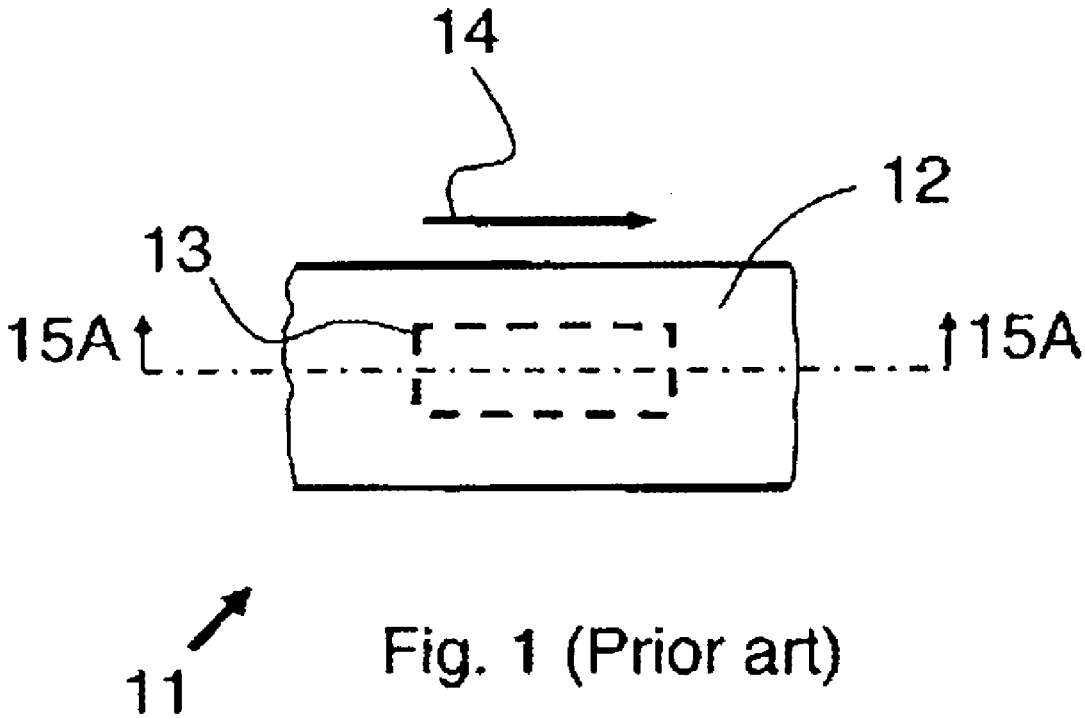
Fig. 1 (Prior art)
FIG. 1 shows a schematic top view of a section of a prior art single layer coil assembly with one winding.

FIG. 1 illustrates a schematic top view of a section of a prior art single layer coil assembly with one winding. Coil assembly 11 may include one layer of conductive material 12 formed as a winding 12 and a magnetic field sensor 13 underneath the layer of conductive material 12. A current may flow along winding 12 and direction of the current is indicated by an arrow 14.

Coil assembly 11 may provide a relatively good homogeneity of a magnetic field but high current is required in order to achieve desired intensity of magnetic field. Accordingly coil assembly 11 may have high power consumption.

Figure 2:
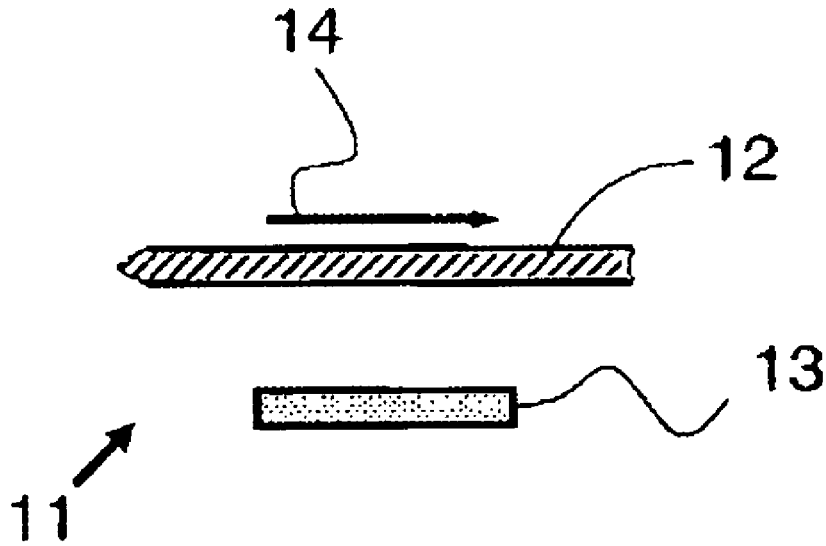
Fig. 2 (Prior art)
FIG. 2 shows a schematic cross section of the single layer coil assembly shown in FIG. 1.

FIG. 2 illustrates a cross sectional view of coil assembly 11 shown in FIG. 1 along line 15A-15A. Because of the good homogeneity of the magnetic field produced by the current inside winding 12, the gap between sensor 13 and winding 12 may be made small.

Figure 3:
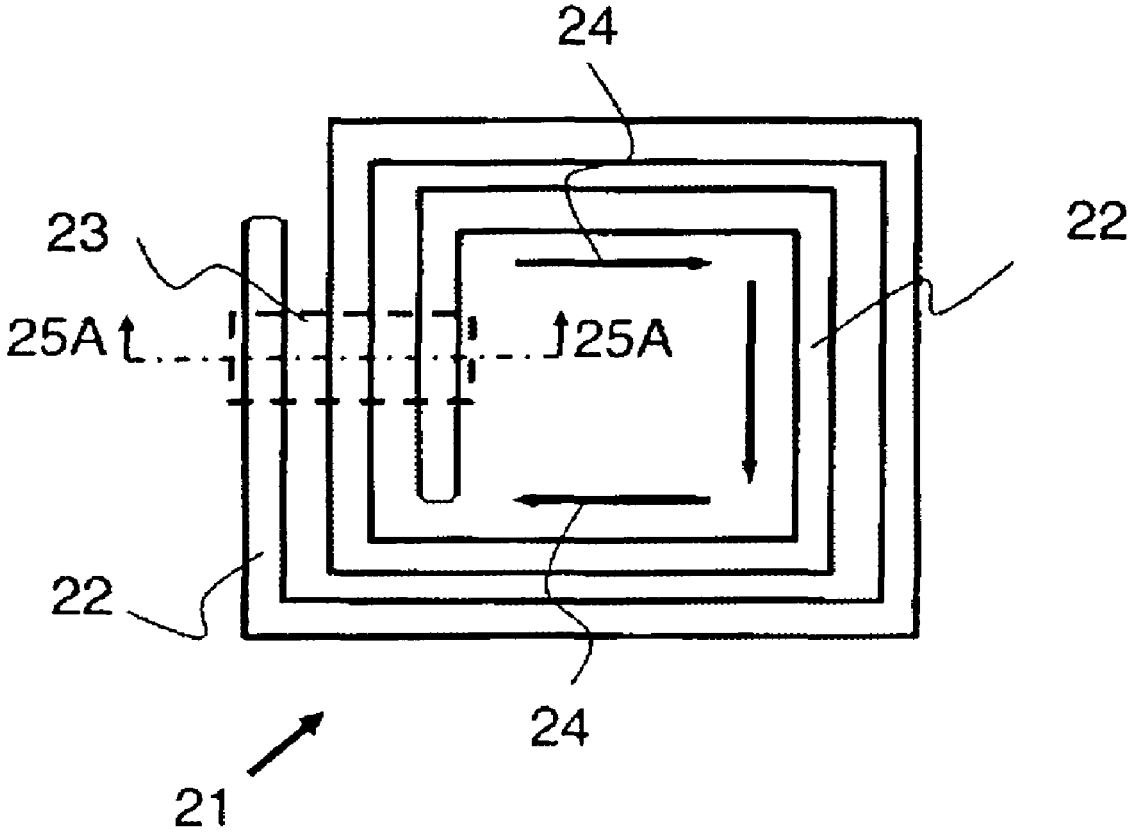
Fig. 3 (Prior art)
FIG. 3 shows a schematic top view of a prior art single layer coil assembly with multiple windings.

FIG. 3 illustrates a schematic top view of a prior art single layer coil assembly with multiple windings. Coil assembly 21 may include one layer of conductive material 22 forming multiple windings 22 and a sensor 23, for example, underneath windings 22. A current may flow inside windings 22 and direction of the current is indicated by an arrow 24.

Coil assembly 21 may provide a magnetic field stronger than that provided by coil assembly 11 in FIG. 1. As a result, coil assembly 21 may be operated at a lower current. But due to the radically increasing extent of windings 22, homogeneity of the magnetic field may be low.

Figure 4:
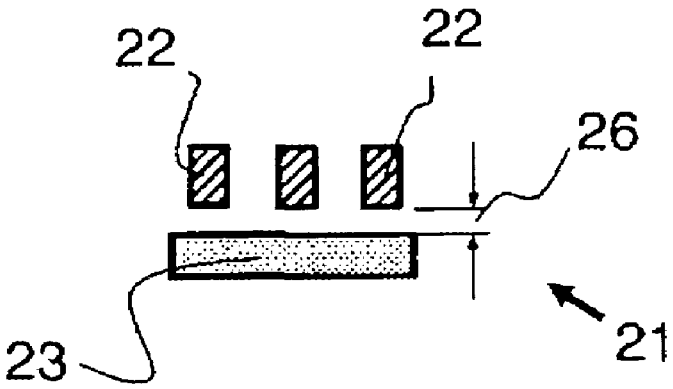
Fig. 4 (Prior art)
FIG. 4 shows a schematic cross section of the single layer coil assembly shown in FIG. 3.

FIG. 4 illustrates a cross sectional view of coil assembly 21 shown in FIG. 3 along line 25A-25A. To certain extent, the in-homogeneity of the magnetic field may be compensated by increasing the gap 26 between windings 22 and sensor 23. On the other hand, as a result of the increased gap, coil assembly 21 may have to be operated at a higher current.

Figure 5:
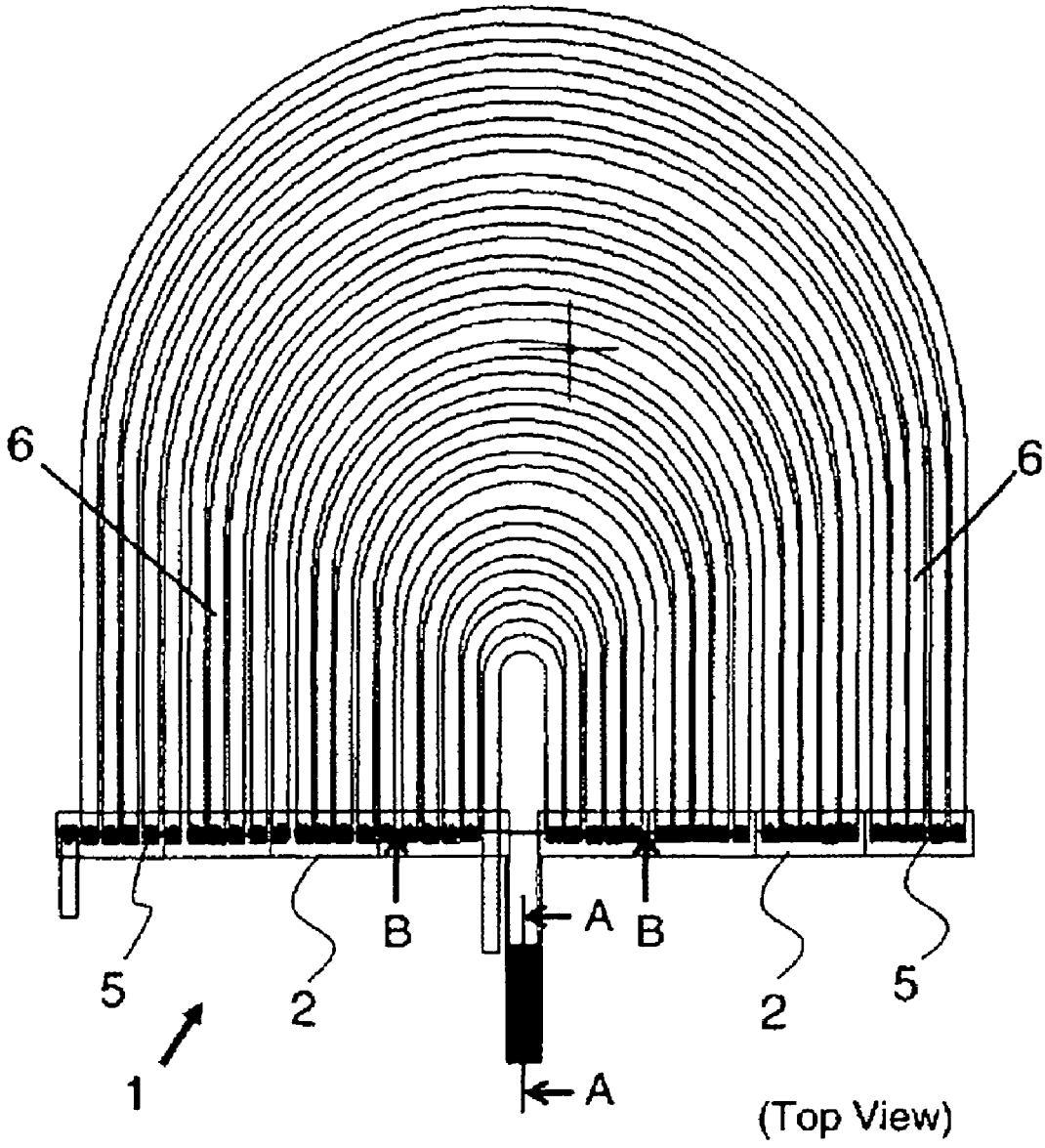
FIG. 5 shows a schematic top view of a thin-film coil assembly according to one embodiment of the invention.

FIG. 5 shows a schematic top view of a coil assembly according to one embodiment of the invention. Coil assembly 1 may include multiple layers of conductive material 2 that may be stacked on top of each other. The layers of conductive material 2 are made in contact with a plurality of interconnects 5 that are formed through an etching process during the production of coil assembly 1 as detailed below. A current going through coil assembly 1 may be re-circulated into different layers of conductive material 2 via a set of return circuits 6, which may be referred to herein as top windings or top coils made of conductive material as well.

Figure 6:
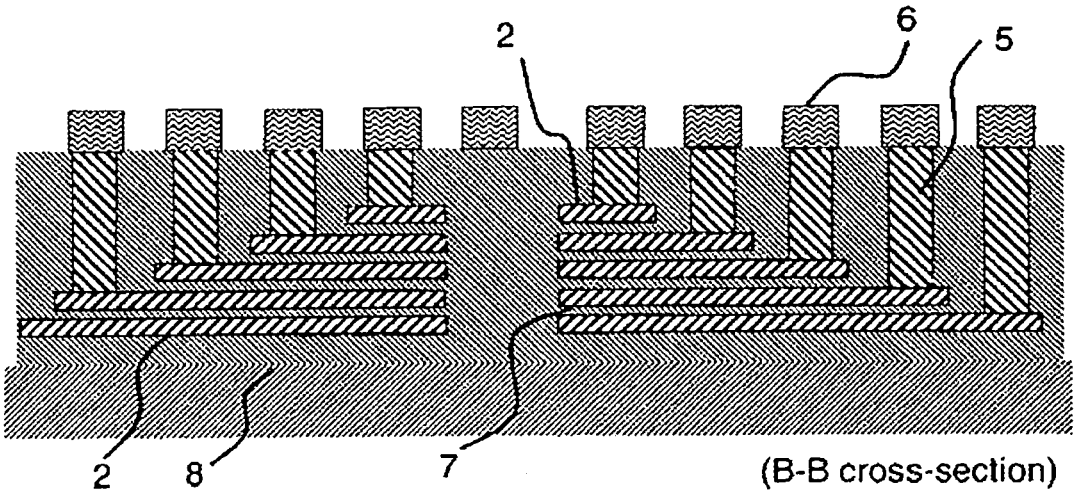
FIG. 6 shows a cross section, along line B-B, of the coil assembly shown in FIG. 5.

According to one embodiment of the invention, coil assembly 1 may comprise multiple layers of conductive material 2, for example, two to approximately twenty layers of conductive material. One or more of the conductive layers 2 forming the windings may have a thickness less than 200 nm, preferably less than 100 nm. Between said windings may be formed layers of insulating material, for example, $Al_2O_3$, having a thickness less than 150 nm, preferably less than 80 nm. According to another embodiment of the invention, coil assembly 1 may have a miniature coil structure whose cross-section along line A-A is shown in FIG. 6. Along line B-B the structure has larger dimensions which improve the electrical bonding of the coil assembly. It should be understood by a person skilled in the art that a coil structure, according to this invention, does not have to include winding formed structures. For example, an active region along line A-A may have straight layers of conductive material.

FIG. 6 shows a schematic cross section along line B-B of FIG. 5 according to one embodiment of the invention. Multiple layers (for example five) of conductive material 2 (for example Cu of thickness for example 60 nm) may form windings 2 which may be stacked on each other. Between the windings or layers 2 may be formed one or more layers of insulating material 7. Insulating layers 7 may be made of $Al_2O_3$ material, for example 40 nm in thickness, which may be formed, for example, through a deposition process. Layers of conductive material 2 and layers of insulating material 7 may be deposited on a substrate 8 through a single process step. The windings or layers 2 may be in contact with one or more interconnects 5. Interconnects 5 may be embedded in etched passageways 30 (FIG. 10) and connecting windings 2 to top winding or upper coil 6.

Figure 7:
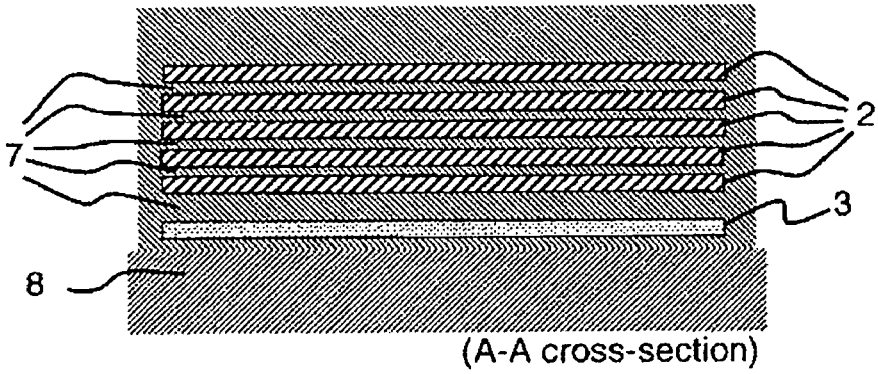
FIG. 7 shows a cross section, along line A-A, of the coil assembly shown in FIG. 5.

FIG. 7 shows a schematic cross section, along line A-A, of coil assembly 1 shown in FIG. 5 according to one embodiment of the invention. An electromagnetic field sensor 3 may first be deposited on a substrate 8. Subsequently, layers of insulating material 7 and conductive material 2, which form the windings, may be deposited alternatively and stacked on top of the sensor.

Figure 8:
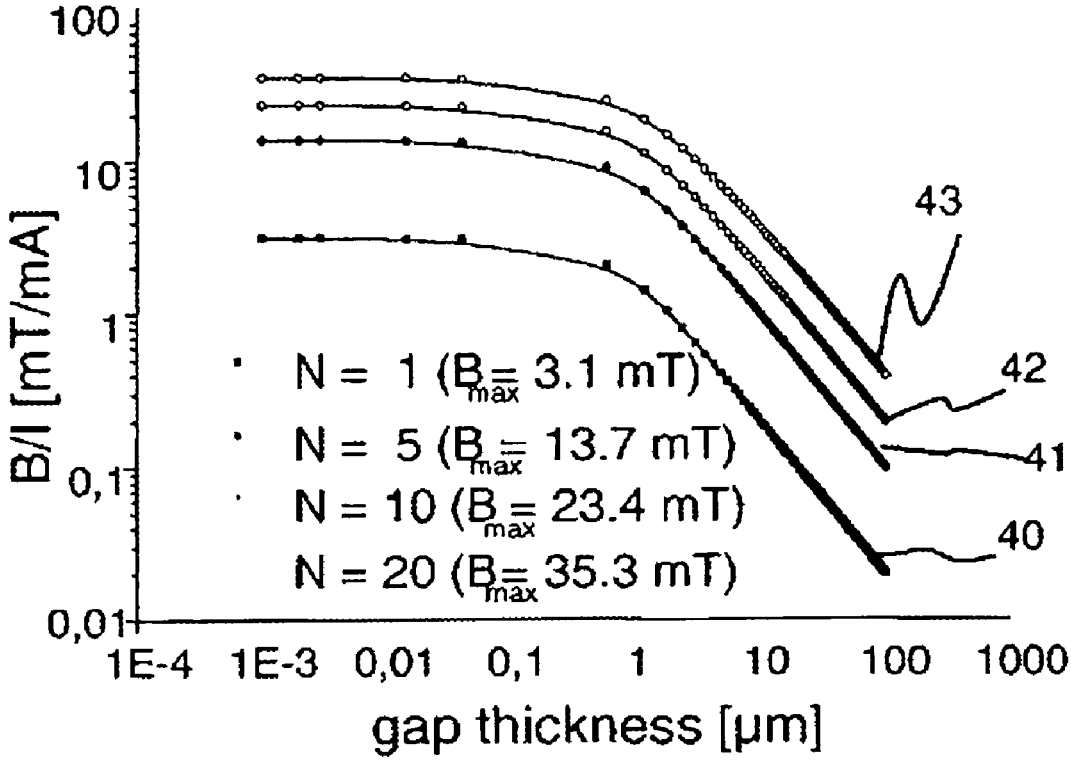
FIG. 8 is a graphical representation of simulated magnetic flux density of various coil assemblies according to different embodiments of the invention.

FIG. 8 shows a graphical representation of simulated magnetic flux density of coil assemblies according to different embodiments of the present invention. The simulation results represent coil assemblies with a 4-μm wide stack of flat sheet wire (conductive layer 2). A pitch distance between top-to-top layers of conductive layer 2 is 0.1 μm. The x-axis of FIG. 8 represents a gap between where the sensor is and the nearest winding or conductive layer 2. The y-axis of FIG. 8 represents the amount of the magnetic flux per coil current (B/I) measured in (mT/mA).

As is shown in FIG. 8, curve 40 illustrates the simulated amount of magnetic flux generated by a conventional single layer coil. Curve 41, 42, and 43 represents, respectively, a 5-layer, a 10-layer, and a 20-layer multilayer coil assembly. It may be seen that the magnetic flux density increases sub-linearly with the number of layers and thus setting an economical limit (N=20) to the total number of layers.

Figure 9:
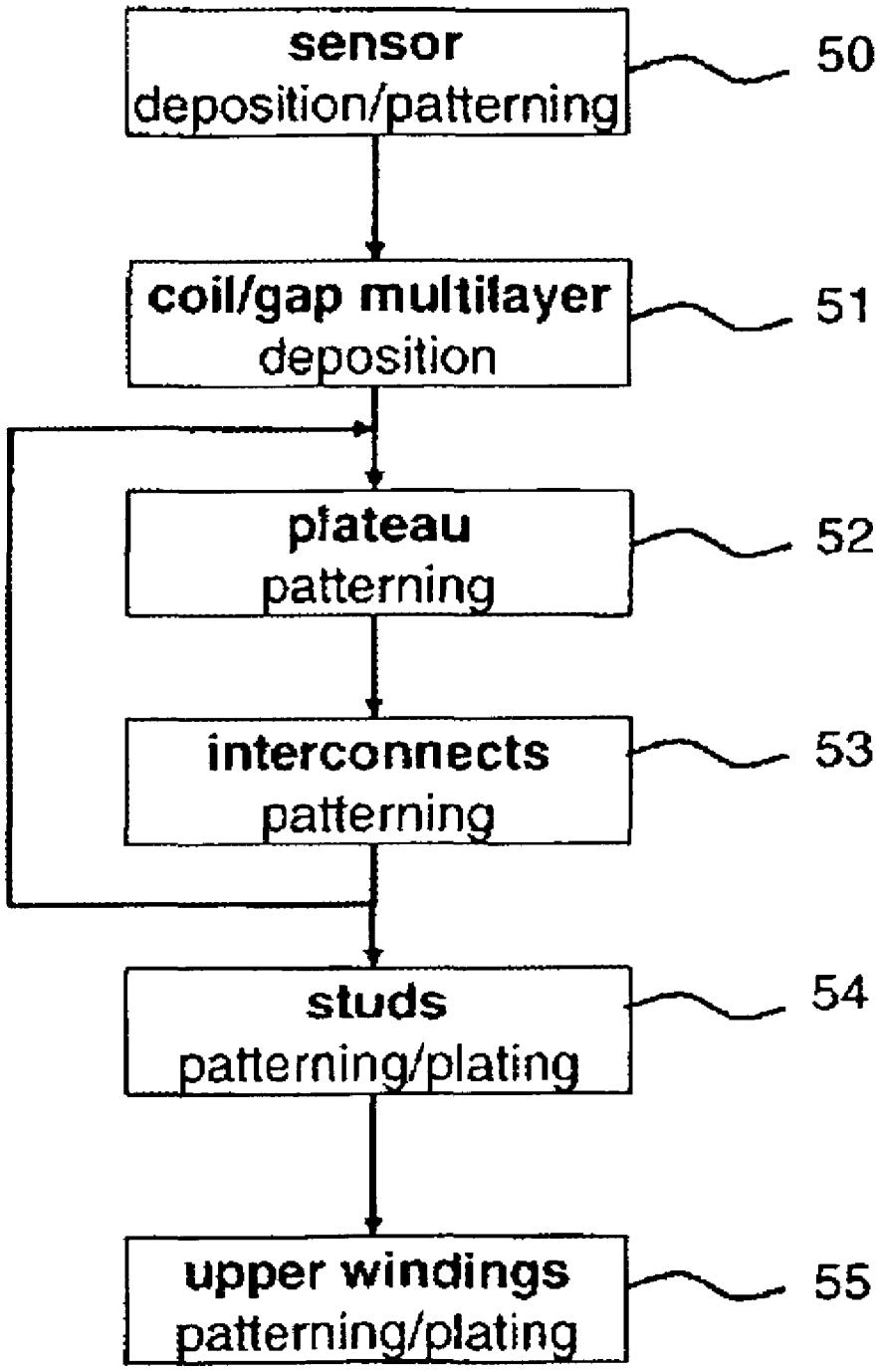
FIG. 9 shows a flow chart of a method for producing a thin-film coil assembly according to one embodiment of the invention.

FIG. 9 shows an illustrative flow chart of a method of producing a coil assembly according to one embodiment of the invention. In a first step 50, a electromagnetic field sensor is formed through deposition using any known thin-film technology. As a next step 51, coils or windings are formed by depositing alternating layers of conductive material (for example, Cu of 40 nm thickness) and insulating material (for example, $Al_2O_3$ of 60 nm thickness). A certain number of conductive layers (e.g., five) and related insulating layers (e.g., four) may construe one plateau and, depending on the number of conductive and insulating layers deposited, multiple plateaus may be formed at step 52.

Within each plateau, passageways for connecting the windings or conductive layers may be formed at step 53 by various technologies, one of which may be an etching method. For example, the insulating layers of $Al_2O_3$ material may be etched away through a reactive ion mill method. According to one embodiment of the invention, the effectiveness of reactive ion etching may have high dependence on the selectivity of gas used in the process. Alternatively, a plasma etching method may be used. The conductive layers of Cu material may be etched by a selective wet etching method wherein the $Al_2O_3$ layers may be used as etch stop layers. As a result, a three dimensional coil structure may be formed. The steps of patterning and forming plateau and passageways (52 and 53) may be repeated for multiple windings or conductive layers. At step 54, studs or interconnects are patterned, plated, and formed at locations of passageways 53. Upper coils or top windings 6 are formed, at step 55, to complete the formation of coil assembly 1 as shown in FIG. 5.

Figure 10:
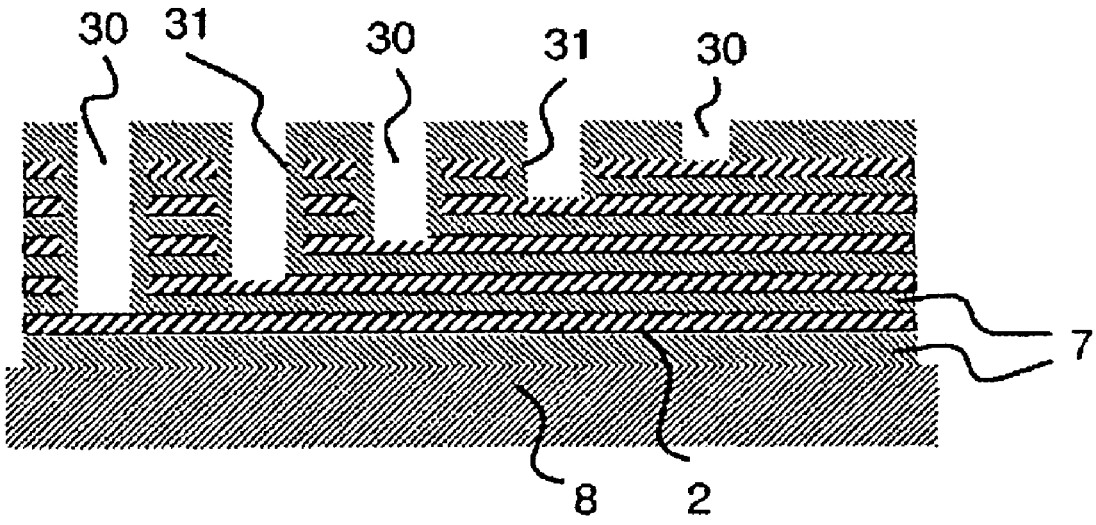
FIG. 10 shows a schematic cross section of a partially produced coil assembly according to one embodiment of the invention.

FIG. 10 shows a schematic cross section of a partially produced coil assembly according to one embodiment of the invention. Coil assembly 1 may include layers of conductive material 2 and insulating material 7 stacked alternatively on top of a substrate 8. One or more passageways 30 may be formed to create corresponding interconnects 5 that contact conductive layers 2.

Passageways 30 may be formed through a process of alternating wet etching of layers 2 of conductive material (for example, Cu) and dry etching of layers 7 of insulating material (for example, $Al_2O_3$). For example, as shown in FIG. 10, in order to create contact for five winding or conductive layers 2, four alternating dry etching/wet etching processes may be first performed to form the first four passageways, and the last passageway on the right most side may be formed by only a dry etching process. The dry etching method used in the etching of insulating layers of $Al_2O_3$ material may have the advantage that, under proper process conditions, sidewalls 31 of passageways 30 may be insulated by a re-deposition of the layers of insulating material 7.

According to some embodiments of the invention, it is possible to provide a coil design able to create an electromagnetic field of more than 20 mT and having a power consumption lower than 1 mA. According to other embodiments of the invention, a multilayer coil may be produced in only a few process steps.

What is claimed is:

1. A method of forming a coil assembly, the method comprising:

providing a substrate;

depositing alternating layers of conductive material and insulating material on said substrate; and forming one or more interconnects to form a three-dimensional structure of said coil assembly, said one or more interconnects making contact with one or more respective said layers of conducting material, wherein forming said one or more interconnects comprises selectively wet etching said layers of conductive material, using said layers of insulating material as etch stop layers, to form one or more passageways, and forming sidewalls of said one or more passageways insulated at least partly by insulating material re-deposited from said layers of insulating material during a dry etch process.

2. The method of claim 1, wherein said depositing alternating layers of conductive material and insulating material comprises depositing said alternating layers in one process step.

3. The method of claim 1, wherein forming said one or more interconnects comprises dry etching said layers of insulating material using a reactive ion mill process.

4. The method of claim 1, wherein forming said three-dimensional structure further comprises forming one or more top windings, said one or more top windings making contact with said one or more interconnects, respectively.

5. The method of claim 4, wherein forming said three-dimensional structure comprises connecting said layers of conductive material in series through said one or more interconnects and said one or more top windings.

6. The method of claim 1, comprising depositing a thin-film sensor on said substrate.

* * * * *